US009623478B2

(12) United States Patent
Tomita et al.

(10) Patent No.: US 9,623,478 B2
(45) Date of Patent: Apr. 18, 2017

(54) DIE CASTING APPARATUS AND DIE CASTING METHOD

(71) Applicant: TOYOTA JIDOSHA KABUSHIKI KAISHA, Toyota-shi (JP)

(72) Inventors: Takashi Tomita, Toyota (JP); Makoto Kikuchi, Nissin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 76 days.

(21) Appl. No.: 14/803,729

(22) Filed: Jul. 20, 2015

(65) Prior Publication Data

US 2016/0023270 A1 Jan. 28, 2016

(30) Foreign Application Priority Data

Jul. 22, 2014 (JP) ..... 2014-148806

(51) Int. Cl.

| | |
|---|---|
| ***B22D 17/20*** | (2006.01) |
| ***B22D 17/30*** | (2006.01) |
| ***B22D 17/32*** | (2006.01) |
| ***B22D 17/10*** | (2006.01) |
| ***B22D 17/14*** | (2006.01) |
| ***B22D 39/00*** | (2006.01) |

(52) U.S. Cl.

CPC ..... *B22D 17/32* (2013.01); *B22D 17/10* (2013.01); *B22D 17/145* (2013.01); *B22D 17/2023* (2013.01); *B22D 17/30* (2013.01); *B22D 39/006* (2013.01)

(58) Field of Classification Search

CPC .... B22D 17/02; B22D 17/04; B22D 17/2023; B22D 17/30; B22D 17/32; B22D 39/003; B22D 39/006

USPC ..... 164/113, 303–318, 500

See application file for complete search history.

(56) References Cited

U.S. PATENT DOCUMENTS 4,714,102 A * 12/1987 Koya ..... B22D 18/08 164/113

4,828,460 A * 5/1989 Saito ..... B22D 17/30 164/147.1

(Continued)

FOREIGN PATENT DOCUMENTS

DE 694 07 034 T2 3/1998

JP 06-297134 A 10/1994

(Continued)

*Primary Examiner* — Kevin E Yoon

(74) *Attorney, Agent, or Firm* — Oblon, McClelland, Maier & Neustadt, L.L.P.

(57) ABSTRACT

In a die casting apparatus, during feeding of molten metal by an electromagnetic pump, a molten metal level sensor repeatedly detects a during-feeding level of the molten metal stored in a molten metal holding furnace; a control unit corrects a molten metal feeding voltage to a during-feeding voltage based on the repeatedly detected during-feeding level of the molten metal such that an amount of the molten metal fed by the electromagnetic pump coincides with a prescribed amount; the control unit applies the during-feeding voltage to the electromagnetic pump to cause the electromagnetic pump to feed the molten metal from the molten metal holding furnace into a plunger sleeve; and casting is performed through an injecting operation in which the molten metal fed into the plunger sleeve is extruded by a plunger tip to be injected into a cavity.

3 Claims, 7 Drawing Sheets

(56) References Cited

U.S. PATENT DOCUMENTS

| | | | | |
|---|---|---|---|---|
| 4,928,933 | A * | 5/1990 | Motomura | B22D 39/003 164/147.1 |
| 5,388,633 | A | 2/1995 | Mercer, II et al. | |
| 6,953,079 | B2 * | 10/2005 | Suzuki | B22D 17/2236 164/256 |
| 2014/0216678 | A1 | 8/2014 | Kikuchi | |
| 2015/0083357 | A1 | 3/2015 | Kikuchi | |

FOREIGN PATENT DOCUMENTS

| | | |
|---|---|---|
| JP | 2002-137051 | 5/2002 |
| JP | 2013-66896 A | 4/2013 |
| JP | 2013-208646 | 10/2013 |

* cited by examiner

DIE CASTING APPARATUS AND DIE CASTING METHOD

INCORPORATION BY REFERENCE

The disclosure of Japanese Patent Application No. 2014-148806 filed on Jul. 22, 2014 including the specification, drawings and abstract is incorporated herein by reference in its entirety.

BACKGROUND OF THE INVENTION

1. Field of the Invention

The invention relates generally to a die casting apparatus and a die casting method, and more specifically to a technique of performing die casting with a cavity of a mold depressurized.

2. Description of Related Art

In die casting according to related art, the following technique is adopted: a prescribed amount of molten metal is fed by a pump from a molten metal holding furnace into a plunger sleeve having a molten metal feed port; and after the completion of feeding of the molten metal, a plunger tip is advanced by an actuator at a prescribed timing to inject the molten metal under high pressure from the plunger sleeve into a cavity of a mold (see, for example, Japanese Patent Application Publication No. 2013-208646 (JP 2013-208646 A)).

In a die casting apparatus according to the related art as described in JP 2013-208646 A, it is necessary to adjust the molten metal feeding voltage to be applied to the pump, based on the level of the molten metal in the molten metal holding furnace. Specifically, as the level of the molten metal is lowered, the molten metal pressure applied to the pump decreases, which makes it necessary to increase the molten metal feeding voltage to be applied to the pump. In view of this, as indicated in FIG. 6, in a die casting apparatus according to related art, the level of molten metal in a molten metal holding furnace is detected before feeding of the molten metal (step S01 in FIG. 6). Then, the molten metal feeding voltage to be applied to a pump is set for each injecting operation based on the detected level of the molten metal (step S02 in FIG. 6). Next, the molten metal is fed into a plunger sleeve (step S03 in FIG. 6). After that, the molten metal is injected under high pressure from the plunger sleeve into a cavity of a mold (step S04 in FIG. 6).

With this configuration, as illustrated in FIG. 7A, the molten metal is fed into the plunger sleeve by applying a prescribed molten metal feeding voltage to the pump during a period of molten metal feeding performed for each injection. However, when the amount of the molten metal in the molten metal holding furnace changes during the molten metal feeding after the level of the molten metal in the molten metal holding furnace is detected, the accuracy in the amount of the molten metal fed into the plunger sleeve may be reduced because adjustment of the molten metal feeding voltage applied to the pump based on such a change is not made. For example, when the amount of the molten metal in the molten metal holding furnace increases during the molten metal feeding, the molten metal pressure applied to the pump increases, which makes it necessary to lower the molten metal feeding voltage to be applied to the pump. In other words, when the molten metal feeding voltage maintained at the set voltage is applied to the pump, the amount of the molten metal fed into the plunger sleeve may increase. More specifically, when the level of the molten metal rises temporarily as indicated in a region $\alpha$0 in FIG. 7B, the amount of the molten metal fed by the pump may increase temporarily as indicated in a region $\beta$0 in FIG. 7B.

SUMMARY OF THE INVENTION

The invention provides a die casting apparatus and a die casting method that make it possible to prevent reduction in the accuracy in the amount of the molten metal fed into a plunger sleeve even when the amount of the molten metal in a molten metal holding furnace changes during feeding of the molten metal.

Next, the constitution of the invention will be described.

An aspect of the invention relates to a die casting apparatus including: a mold having a cavity; a plunger sleeve having a molten metal feed port, the plunger sleeve being communicated with the cavity; a plunger tip provided at a distal end portion of a support shaft, the plunger tip configured to be slidable in the plunger sleeve in an axial direction of the plunger sleeve when the support shaft is inserted into the plunger sleeve; a depressurizing unit communicated with the cavity; a molten metal holding furnace in which molten metal is stored; a molten metal level sensor that detects a level of the molten metal stored in the molten metal holding furnace; a pump that feeds the molten metal from the molten metal holding furnace into the plunger sleeve; and a control unit configured to set a molten metal feeding voltage based on the level of the molten metal detected by the molten metal level sensor, and the control unit configured to apply the molten metal feeding voltage to the pump to adjust an amount of the molten metal fed by the pump to a prescribed amount set in advance. The molten metal level sensor detects an initial level of the molten metal stored in the molten metal holding furnace before the pump starts feeding of the molten metal. The control unit sets an initial voltage as the molten metal feeding voltage based on the initial level of the molten metal such that the amount of the molten metal fed by the pump coincides with the prescribed amount. The control unit applies the initial voltage to the pump to cause the pump to start feeding of the molten metal from the molten metal holding furnace into the plunger sleeve. The molten metal level sensor repeatedly detects a during-feeding level of the molten metal stored in the molten metal holding furnace during the feeding of the molten metal by the pump. The control unit corrects the molten metal feeding voltage to a during-feeding voltage based on the repeatedly detected during-feeding level of the molten metal such that the amount of the molten metal fed by the pump coincides with the prescribed amount. The control unit applies the during-feeding voltage to the pump to cause the pump to feed the molten metal from the molten metal holding furnace into the plunger sleeve. Casting is performed through an injecting operation in which the molten metal fed into the plunger sleeve is extruded by the plunger tip to be injected into the cavity.

In the die casting apparatus according to the above aspect, when the during-feeding level of the molten metal deviates from a reference value during the feeding of the molten metal, the control unit may correct the molten metal feeding voltage by adjusting the during-feeding voltage based on a deviation from the reference value.

In the die casting apparatus according to the above aspect, the control unit may store, as the reference value, a predicted change in the level of the molten metal in a case where an amount of the molten metal in the molten metal holding furnace decreases such that the amount of the molten metal fed by the pump coincides with the prescribed amount.

Another aspect of the invention relates to a die casting method performed by a die casting apparatus, the die casting apparatus including a mold having a cavity, a plunger sleeve having a molten metal feed port, the plunger sleeve being communicated with the cavity, a plunger tip provided at a distal end portion of a support shaft, the plunger tip configured to be slidable in the plunger sleeve in an axial direction of the plunger sleeve when the support shaft is inserted into the plunger sleeve, a depressurizing unit communicated with the cavity, a molten metal holding furnace in which molten metal is stored, a molten metal level sensor that detects a level of the molten metal stored in the molten metal holding furnace, a pump that feeds the molten metal from the molten metal holding furnace into the plunger sleeve, and a control unit configured to set a molten metal feeding voltage based on the level of the molten metal detected by the molten metal level sensor, and the control unit configured to apply the molten metal feeding voltage to the pump to adjust an amount of the molten metal fed by the pump to a prescribed amount set in advance. The die casting method includes: detecting, by the molten metal level sensor, an initial level of the molten metal stored in the molten metal holding furnace before the pump starts feeding of the molten metal; setting, by the control unit, an initial voltage as the molten metal feeding voltage based on the initial level of the molten metal such that the amount of the molten metal fed by the pump coincides with the prescribed amount; applying, by the control unit, the initial voltage to the pump to cause the pump to start feeding of the molten metal from the molten metal holding furnace into the plunger sleeve; repeatedly detecting, by the molten metal level sensor, a during-feeding level of the molten metal stored in the molten metal holding furnace during the feeding of the molten metal by the pump; correcting, by the control unit, the molten metal feeding voltage to a during-feeding voltage based on the repeatedly detected during-feeding level of the molten metal such that the amount of the molten metal fed by the pump coincides with the prescribed amount; applying, by the control unit, the during-feeding voltage to the pump to cause the pump to feed the molten metal from the molten metal holding furnace into the plunger sleeve; and performing casting through an injecting operation in which the molten metal fed into the plunger sleeve is extruded by the plunger tip to be injected into the cavity.

According to the aspects of the invention, the following advantageous effect is obtained.

With the die casting apparatus and the die casting method according to the invention, it is possible to prevent reduction in the accuracy in the amount of molten metal fed into a plunger sleeve even when the amount of molten metal in a molten metal holding furnace changes after the level of the molten metal in the molten metal holding furnace is detected.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an example embodiment of the invention will be described. It should be noted that the technical scope of the invention is not be limited to the following embodiment.

Configuration of Die Casting Apparatus 30

A die casting apparatus 30 according to an embodiment of the invention will be described with reference to FIG. 1. In this specification, description will be provided with the right side in FIG. 1 being the right side of the die casting apparatus 30 and the left side in FIG. 1 being the left side of the die casting apparatus 30, for the sake of convenience.

Figure 1:
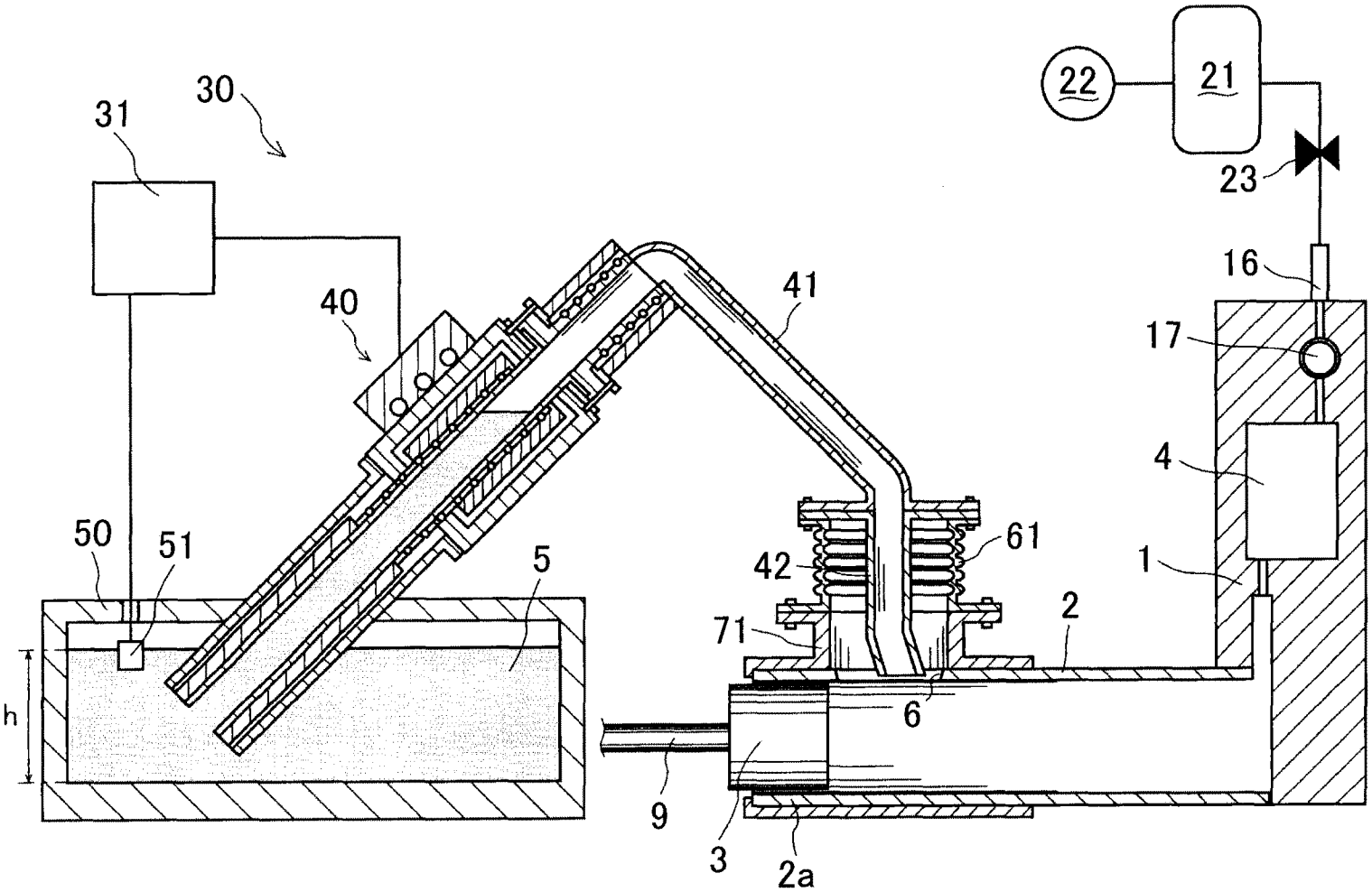
FIG. 1 is a schematic sectional view of a die casting apparatus according to an embodiment of the invention.

As illustrated in FIG. 1, a mold 1 of the die casting apparatus 30 has a cavity 4, and the mold 1 is provided with a plunger sleeve 2 in a generally cylindrical shape. The plunger sleeve 2 is communicated with the cavity 4 and protrudes leftward from the mold 1. A plunger tip 3 in a short columnar shape is configured to be slid rightward in the plunger sleeve 2 to extrude molten metal 5 such as aluminum fed into the plunger sleeve 2, thereby injecting the molten metal 5 into the cavity 4.

The plunger sleeve 2 has a molten metal feed port 6. The molten metal 5 transferred through molten metal feed pipes 41, 42 (described later) is fed into the plunger sleeve 2 from the molten metal feed port 6. A support shaft 9 is inserted into the plunger sleeve 2, and is controlled to be advanced and retracted by an actuator (not illustrated) such as an air cylinder or a hydraulic cylinder. The plunger tip 3 provided at a distal end portion of the support shaft 9 is configured to be slid in the plunger sleeve 2 along the axial direction of the plunger sleeve 2.

The mold 1 is provided with a suction port 16 that is communicated with the cavity 4 to suction the air in the cavity 4. A shut-off valve 17 is provided on a path that connects the cavity 4 to the suction port 16. By connecting the suction port 16 to a depressurizing unit (a depressurizing tank 21 and a vacuum pump 22, in the present embodiment), the depressurizing unit is communicated with the cavity 4. On a connection path that connects the depressurizing tank 21 and the suction port 16 to each other, an opening-closing valve 23 that opens and closes the connection path is provided. When the opening-closing valve 23 on the connection path is opened in accordance with the injection control, depressurization of the cavity 4 is started.

The die casting apparatus 30 includes a molten metal holding furnace 50 and an electromagnetic pump 40. The molten metal 5 is stored in the molten metal holding furnace 50. One end of the electromagnetic pump 40 is immersed in the molten metal 5 in the molten metal holding furnace 50 at an angle of approximately 45 degrees, and the electromagnetic pump 40 draws the molten metal 5 up from the molten metal holding furnace 50. An inner peripheral portion of the electromagnetic pump 40 is made of ceramic. The electromagnetic pump 40 is electrically connected to a control unit 31. When the control unit 31 applies a molten metal feeding voltage to a coil embedded in the electromagnetic pump 40, the electromagnetic pump 40 draws up the molten metal 5 using an electromagnetic force. In other words, the amount of the molten metal fed by the electromagnetic pump 40 is controlled by applying a molten metal feeding voltage set by the control unit 31 to the electromagnetic pump 40. In the present embodiment, the electromagnetic pump 40 is used as a pump. However, other kinds of pumps such as a turbopump including a rotor and a positive displacement pump including a rotor may be used.

The control unit 31 mainly includes a memory unit and a computing unit. The memory unit includes, for example, a random-access memory (RAM) and a read-only memory (ROM). The computing unit is a central processing unit (CPU). A general-purpose personal computer or the like is used as the control unit 31. For example, programs relating to the control of the electromagnetic pump 40 are stored in the memory unit. The information input from an input unit under a command from the computing unit is temporarily stored in the memory unit.

The molten metal holding furnace 50 is provided with a molten metal level sensor 51. The molten metal level sensor 51 is a float sensor floating on the molten metal 5 stored in the molten metal holding furnace 50, and detects a level h of the molten metal 5. The information on the level h of the molten metal 5 detected by the molten metal level sensor 51 is transmitted to the control unit 31.

When the information on the level h from the molten metal level sensor 51 is input into the control unit 31, the control unit 31 sets a molten metal feeding voltage based on the level h of the molten metal 5, and applies the molten metal feeding voltage to the electromagnetic pump 40 for only a prescribed molten metal feeding period set in advance. In this way, the amount of the molten metal 5 fed by the electromagnetic pump 40 is controlled by the control unit 31 to be adjusted to a prescribed amount set in advance.

Figure 3:
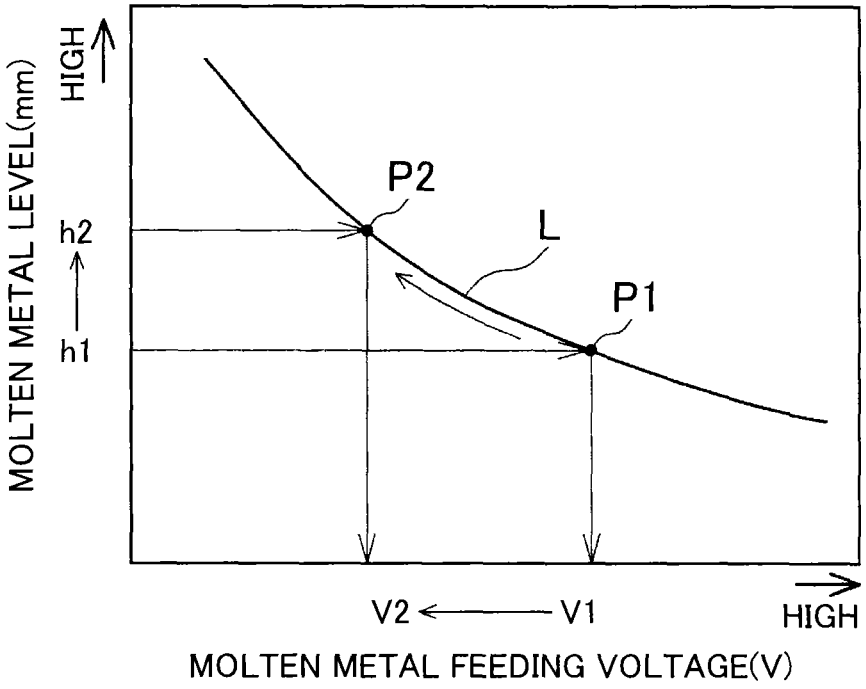
FIG. 3 is a graph indicating the relationship between the level of the molten metal and the molten metal feeding voltage.

With reference to FIG. 3, a method of setting a molten metal feeding voltage by the control unit 31 will be briefly described. A curve L indicated in FIG. 3 is a graph indicating the relationship between the level h of the molten metal 5 and the molten metal feeding voltage when the molten metal feeding amount coincides with a prescribed amount set in advance. As illustrated in FIG. 3, the curve L is set such that the molten metal feeding voltage increases with a decrease in the level h of the molten metal 5 (i.e., such that there is a negative correlation between the level h of the molten metal 5 and the molten metal feeding voltage). This is because, as the level h decreases, the pressure of the molten metal 5 applied to the electromagnetic pump 40 decreases, so that a higher molten metal feeding voltage is required. As illustrated in FIG. 3, when the level h is h1, the control unit 31 determines a point P1 on the curve L, the point P1 corresponding to the level h1, and sets a molten metal feeding voltage V1 based on the point P1. When the level h of the molten metal 5 increases from h1 to h2, the control unit 31 determines a point P2 on the curve L, the point P2 corresponding to the level h2, and sets a molten metal feeding voltage V2 based on the point P2. That is, when the level h increases from h1 to h2, the molten metal feeding voltage is decreased from V1 to V2 as illustrated in FIG. 3. In this way, the control unit 31 adjusts the amount of the molten metal 5 fed by the electromagnetic pump 40 to a prescribed amount set in advance, by setting the molten metal feeding voltage according to an increase or a decrease in the level h of the molten metal 5.

As described above, while the electromagnetic pump 40 is feeding the molten metal 5 such that the molten metal feeding amount coincides with a prescribed amount, the molten metal 5 in the molten metal holding furnace 50 decreases due to the molten metal feeding. At this time, the control unit 31 stores, as "reference value", a predicted change in the level h of the molten metal 5 in a case where the amount of the molten metal 5 in the molten metal holding furnace 50 decreases such that the molten metal feeding amount coincides with the prescribed amount (see a two-dot chain line in FIG. 5A). That is, if the assumption is made that the molten metal feeding voltage is constant, when the level of the molten metal 5 exceeds the reference value during molten metal feeding, the molten metal feeding amount exceeds the prescribed amount, whereas when the level of the molten metal 5 falls below the reference value, the molten metal feeding amount falls below the prescribed amount.

The die casting apparatus 30 further includes the molten metal feed pipes 41, 42 made of ceramic (hereinafter, the molten metal feed pipes 41, 42 will be collectively referred to as "assembly of the molten metal feed pipes 41, 42"). The assembly of the molten metal feed pipes 41, 42 has an upper end, which is one end, connected to the electromagnetic pump 40, and a lower end, which is the other end, located at a position at which the lower end faces the molten metal feed port 6. More specifically, the assembly of the molten metal feed pipes 41, 42 is formed by coupling the upper molten metal feed pipe 41 and the lower molten metal feed pipe 42 to each other. The upper molten metal feed pipe 41 is connected at its upper end portion to an upper end portion of the electromagnetic pump 40, and is disposed so as to be inclined toward the plunger sleeve 2. The lower molten metal feed pipe 42 is connected at its upper end portion to a lower end portion of the upper molten metal feed pipe 41, and is disposed so as to be perpendicular to the molten metal feed port 6.

The assembly of the molten metal feed pipes 41, 42 is coupled to the plunger sleeve 2 via an intermediate pipe 61 having a bellows structure and serving as a vibration absorber. More specifically, the plunger sleeve 2 is provided with heat insulation member 71, which is made of metal or ceramic and formed in a shape of a pipe communicated with the molten metal feed port 6 of the plunger sleeve 2. That is, the intermediate pipe 61 is disposed on the plunger sleeve 2 via the heat insulation member 71.

The intermediate pipe 61 is disposed on the upper side of the heat insulation member 71, and a junction between the upper molten metal feed pipe 41 and the lower molten metal feed pipe 42 is supported by the intermediate pipe 61. That is, an upper end portion of the intermediate pipe 61, which is located on the upper molten metal feed pipe 41 side, is coupled to the junction between the upper molten metal feed pipe 41 and the lower molten metal feed pipe 42, which is an intermediate portion of the assembly of the molten metal feed pipes 41, 42, and a lower end portion of the lower molten metal feed pipe 42, which is the other end portion of the assembly of the molten metal feed pipes 41, 42, is located near the molten metal feed port 6.

The die casting apparatus 30 according to the present embodiment is configured as described above, and performs casting by performing an injecting operation. In the injecting operation, the molten metal 5 fed into the plunger sleeve 2 by the electromagnetic pump 40 from the molten metal holding furnace 50 through the molten metal feed pipes 41, 42 is extruded rightward by the plunger tip 3 to be injected into the cavity 4.

Figure 2A:
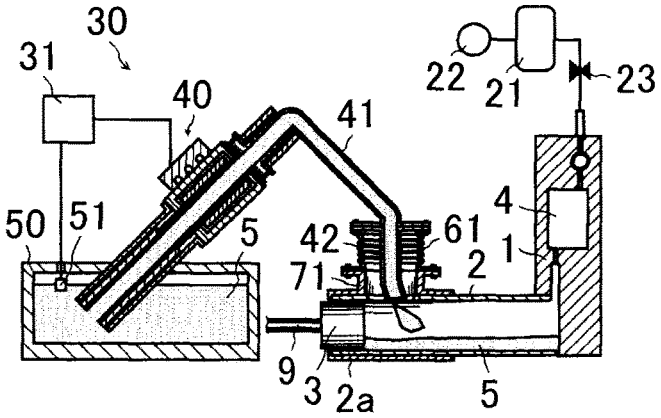
FIG. 2A is a schematic sectional view of the die casting apparatus during feeding of molten metal.
Figure 2B:
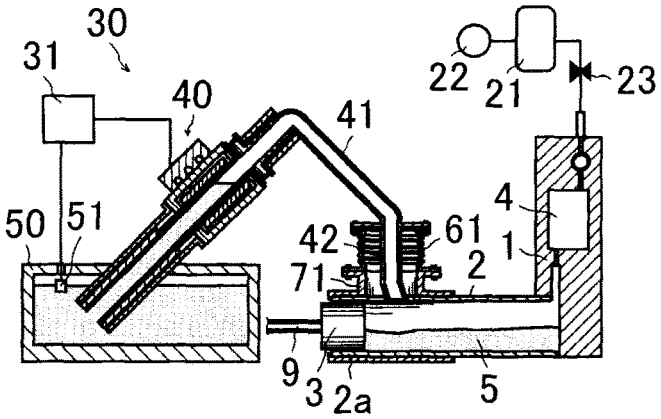
FIG. 2B is a schematic sectional view of the die casting apparatus before depressurization.

More specifically, in vacuum die casting performed by the die casting apparatus 30, first, during molten metal feeding performed in the die casting apparatus 30 as illustrated in FIG. 2A, the molten metal 5 is drawn up by an electromagnetic force of the electromagnetic pump 40 and the molten metal 5 is fed through the molten metal feed pipes 41, 42 into the plunger sleeve 2 from the molten metal feed port 6. A distal end portion of the plunger tip 3 in the injection direction is located at a position before the molten metal feed port 6 (i.e., a position at which the plunger tip 3 has not reached the molten metal feed port 6), so that the molten metal feed port 6 is left fully open. As illustrated in FIG. 2B, during molten metal feeding, the opening-closing valve 23 is kept closed, so that depressurization is not performed.

Figure 2C:
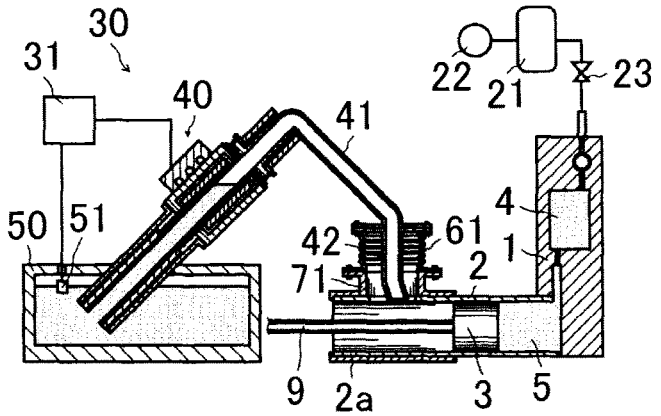
FIG. 2C is a schematic sectional view of the die casting apparatus during injection.

During injection performed in the die casting apparatus 30 as illustrated in FIG. 2C, the molten metal 5 is injected into the cavity 4, in which a prescribed degree of vacuum is secured, through the injecting operation of the plunger tip 3. During a period in which the injecting operation is performed, the opening-closing valve 23 is kept open, so that the air in the cavity 4 is continuously suctioned.

In a state where the air in the cavity 4 is suctioned by the depressurizing unit in a depressurization step, the molten metal 5 is injected into the cavity 4 in an injection step. Then, after the plunger tip 3 has completely moved to the injection side, the opening-closing valve 23 is closed and the depressurization is completed. After a product in the cavity 4 solidifies, the mold is removed to take out the product.

Die Casting Method Performed by Die Casting Apparatus 30

Next, a die casting method performed by the die casting apparatus 30 will be described in detail with reference to FIG. 3, FIG. 4 and FIGS. 5A, 5B. In the die casting method, first, as indicated in step S1 in FIG. 4, the molten metal level sensor 51 detects a level h (initial level) of the molten metal 5 stored in the molten metal holding furnace 50 before the electromagnetic pump 40 starts feeding of the molten metal 5. Then, as indicated in step S2 in FIG. 4, the control unit 31 sets an initial voltage as a molten metal feeding voltage based on the initial level of the molten metal 5 such that the amount of the molten metal 5 fed by the electromagnetic pump 40 coincides with a prescribed amount (initial voltage setting step).

Figure 4:
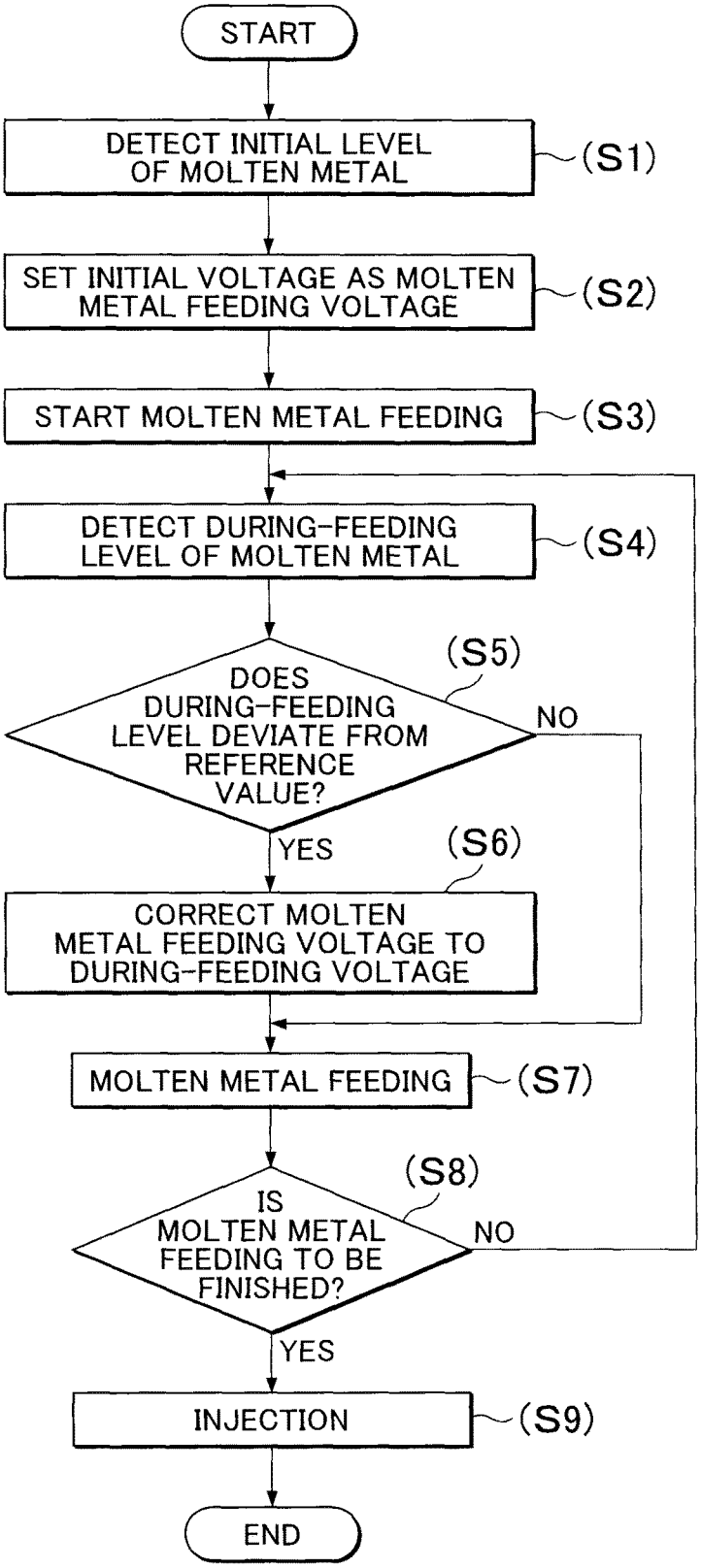
FIG. 4 is a flowchart of a die casting method performed by the die casting apparatus.

Next, as indicated in step S3 in FIG. 4, the control unit 31 applies the initial voltage to the electromagnetic pump 40 to cause the electromagnetic pump 40 to start feeding the molten metal 5 from the molten metal holding furnace 50 into the plunger sleeve 2 (molten metal feeding starting step).

Next, as indicated in step S4 in FIG. 4, during the molten metal feeding performed by the electromagnetic pump 40, the molten metal level sensor 51 detects a level h (during-feeding level) of the molten metal 5 stored in the molten metal holding furnace 50. Then, as indicated in step S5 in FIG. 4, the control unit 31 determines whether or not the during-feeding level deviates from the reference value. When the control unit 31 determines that the during-feeding level deviates from the reference value, the control unit 31 proceeds on to step S6 in FIG. 4, where the control unit 31 corrects the molten metal feeding voltage to a during-feeding voltage based on the during-feeding level such that the amount of the molten metal 5 fed by the electromagnetic pump 40 coincides with the prescribed amount (molten metal feeding voltage correcting step). On the other hand, when the control unit 31 determines that the during-feeding level does not deviate from the reference value, the control unit 31 proceeds on to step S7 in FIG. 4.

Next, as indicated in step S7 in FIG. 4, the control unit 31 applies the during-feeding voltage to the electromagnetic pump 40, so that the molten metal 5 is fed from the molten metal holding furnace 50 into the plunger sleeve 2 by the electromagnetic pump 40 (molten metal feeding step). Then, as indicated in step S8 in FIG. 4, the control unit 31 determines whether or not a prescribed metal feeding period has elapsed from the start of the molten metal feeding (whether or not the molten metal feeding should be finished) . When the control unit 31 determines that the molten metal feeding period has elapsed, the control unit 31 stops the molten metal feeding and proceeds on to step S9 in FIG. 4, where casting is performed through the injecting operation in which the molten metal 5 fed into the plunger sleeve 2 is extruded by the plunger tip 3 to be injected into the cavity 4 depressurized by the depressurizing unit (injection casting step). Then, the die casting method ends. On the other hand, when the control unit 31 determines that the molten metal feeding period has not elapsed yet, the control unit 31 proceeds on to step S4 in FIG. 4 while continuing the molten metal feeding, and detects a level h (during-feeding level) of the molten metal 5 during the molten metal feeding. That is, until the molten metal feeding period has elapsed from the start of the molten metal feeding, the level h (during-feeding level) of the molten metal 5 during the molten metal feeding is detected repeatedly at prescribed intervals (of 0.5 second, for example).

Figure 5A:
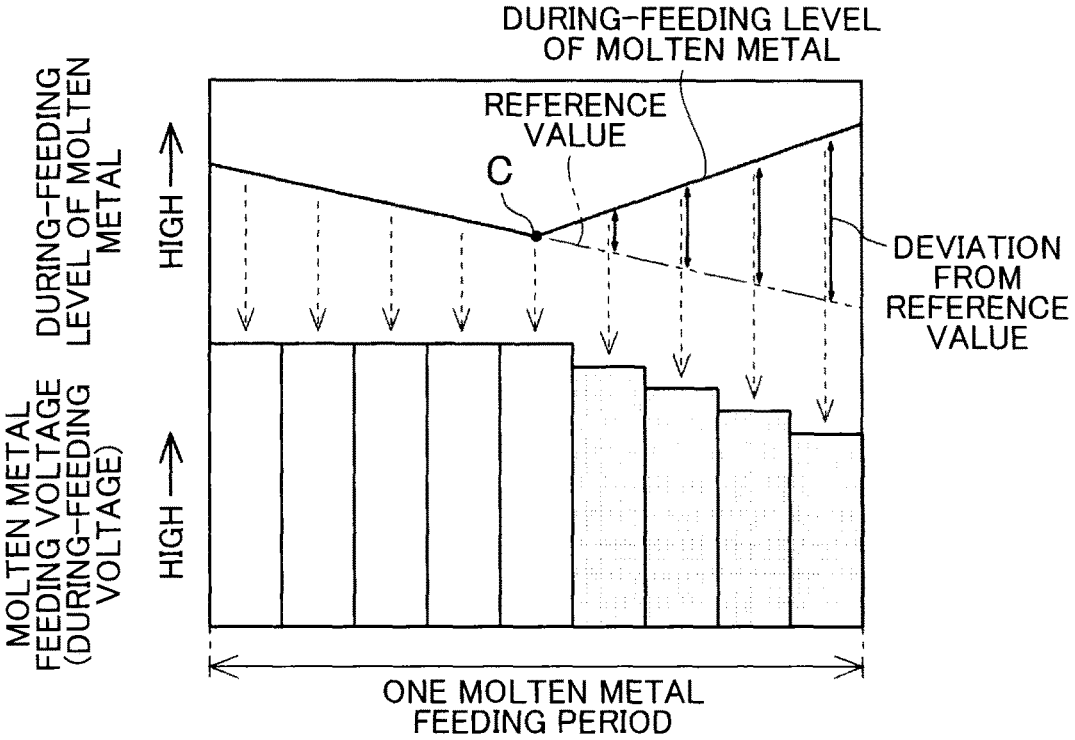
FIG. 5A is a graph indicating the during-feeding voltage when the level of the molten metal changes in one feeding of the molten metal.

As described above, in the die casting method performed by the die casting apparatus 30 according to the present embodiment, when the during-feeding level deviates from the reference value during the molten metal feeding performed by the electromagnetic pump 40, the control unit 31 corrects the molten metal feeding voltage to the during-feeding voltage based on the during-feeding level such that the amount of the molten metal 5 fed by the electromagnetic pump 40 coincides with the prescribed amount. More specifically, when the during-feeding level deviates from the reference value during the molten metal feeding as indicated by a point C in FIG. 5A, the control unit 31 corrects the molten metal feeding voltage by adjusting the during-feeding voltage based on the deviation from the reference value (in FIG. 5A, the molten metal feeding voltage after correction (during-feeding voltage) is shaded). In FIG. 5A, the during-feeding level exceeds the reference value, and thus the during-feeding voltage is decreased to correct the molten metal feeding voltage. Conversely, when the during-feeding level falls below the reference value, the during-feeding voltage needs to be increased to correct the molten metal feeding voltage.

Because the die casting apparatus 30 and the die casting method according to the present embodiment are configured as described above, it is possible to prevent reduction in the accuracy in the amount of the molten metal fed into the plunger sleeve 2 even when the amount of the molten metal in the molten metal holding furnace 50 changes during the molten metal feeding. That is, the amount of the molten metal fed into the plunger sleeve is maintained at a prescribed amount, because the molten metal feeding voltage to be applied to the electromagnetic pump 40 is corrected to the during-feeding voltage as described above when the amount of the molten metal (the level of the molten metal) in the molten metal holding furnace 50 changes during the molten metal feeding. For example, when the level h of the molten metal 5 in the molten metal holding furnace 50 rises during the molten metal feeding, the feeding voltage to be applied to the electromagnetic pump 40 is corrected to a lower voltage because the molten metal pressure applied to the electromagnetic pump 40 increases. That is, it is possible to maintain the molten metal feeding amount at the prescribed amount by adjusting the molten metal feeding voltage to be applied to the electromagnetic pump 40 based on the variations in the level h of the molten metal 5 in the molten metal holding furnace 50 during the molten metal feeding.

Figure 5B:
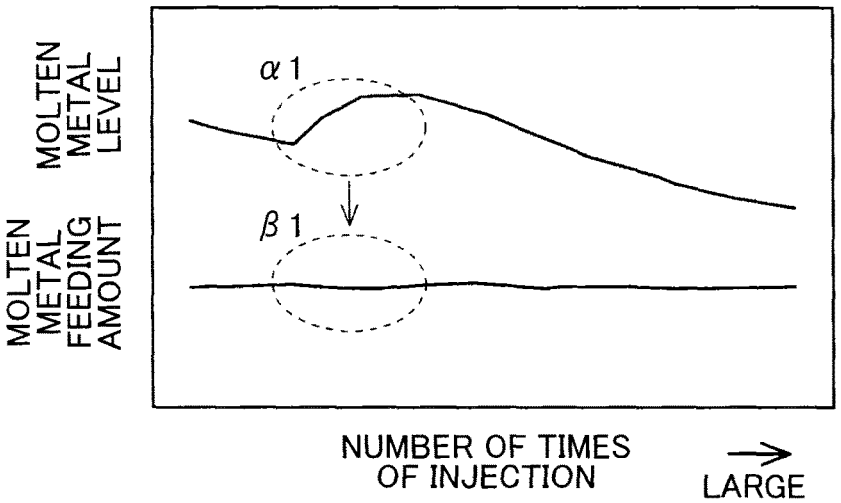
FIG. 5B is a graph indicating the relationship between the level of the molten metal and the molten metal feeding amount according to the embodiment.
Figure 6:
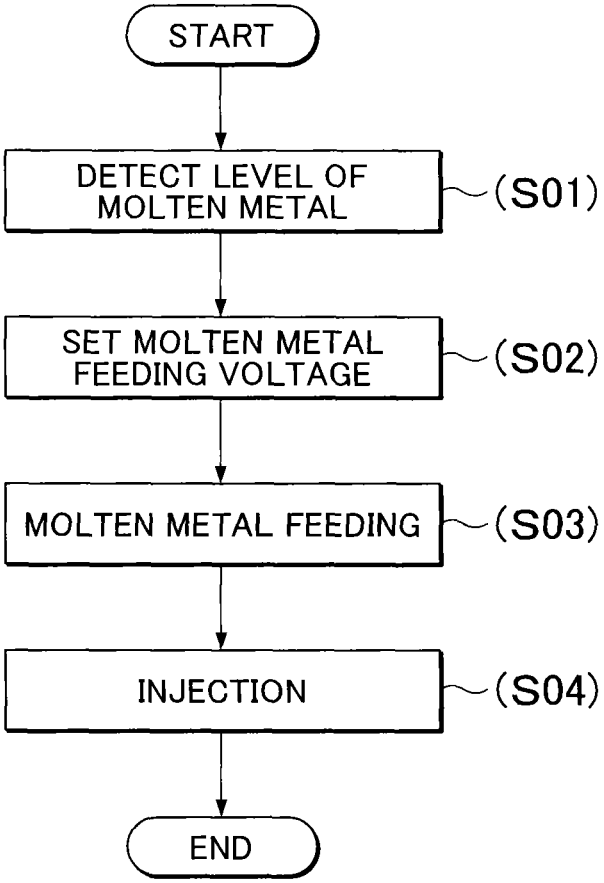
FIG. 6 RELATED ART
FIG. 6 is a flowchart of a die casting method performed by a die casting apparatus according to related art.
Figure 7A:
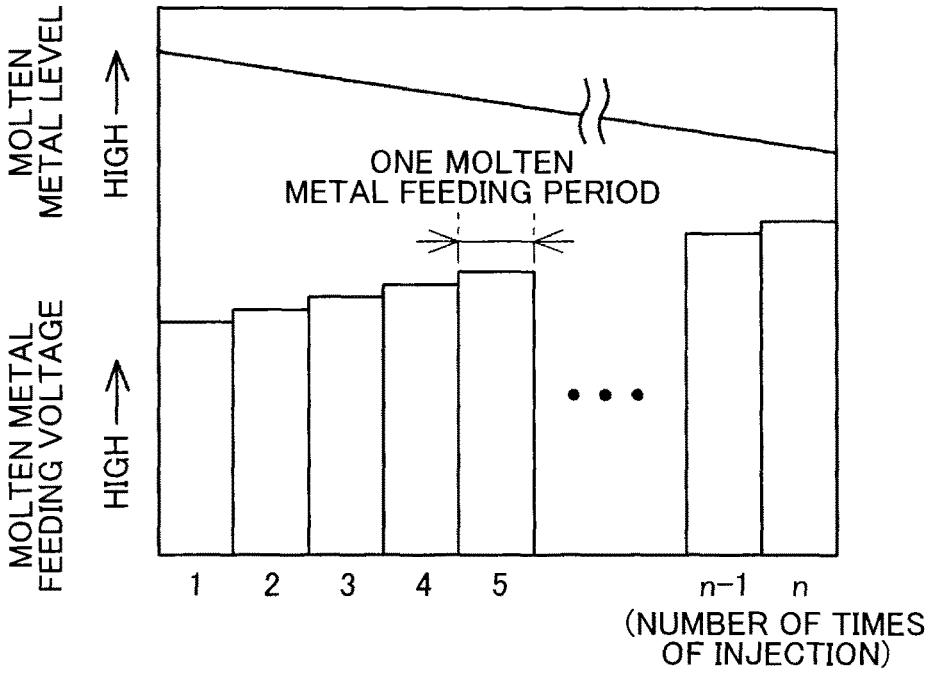
FIG. 7A RELATED ART
FIG. 7A is a graph indicating the relationship between the level of molten metal and the molten metal feeding voltage in the die casting apparatus according to the related art.
Figure 7B:
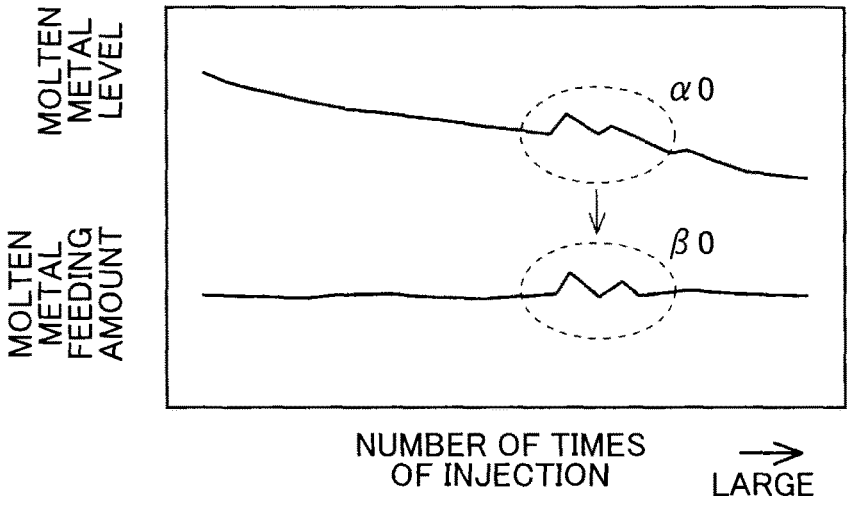
FIG. 7B is a graph indicating the relationship between the level of the molten metal and the molten metal feeding amount in the related art.

The results of tests performed by the die casting method using the die casting apparatus 30 according to the present embodiment will be described with reference to FIG. 5B. FIG. 5B indicates the relationship between the level h of the molten metal 5 in the molten metal holding furnace 50 and the molten metal feeding amount, obtained by performing injection casting multiple times. Even when the level h rose as indicated in a region α1 in FIG. 5B, no variation was found in the amount of molten metal fed by the electromagnetic pump 40 as indicated in a region β1 in FIG. 5B. Thus, it was confirmed that the die casting apparatus 30 according to the present embodiment makes it possible to prevent reduction in the accuracy in the amount of the molten metal fed into the plunger sleeve 2 even when injection casting is performed multiple times.

What is claimed is:

1. A die casting method performed by a die casting apparatus, the die casting apparatus including a mold having a cavity, a plunger sleeve having a molten metal feed port, the plunger sleeve being communicated with the cavity, a plunger tip provided at a distal end portion of a support shaft, the plunger tip configured to be slidable in the plunger sleeve in an axial direction of the plunger sleeve when the support shaft is inserted into the plunger sleeve, a depressurizing unit communicated with the cavity, a molten metal holding furnace in which molten metal is stored, a molten metal level sensor that detects a level of the molten metal stored in the molten metal holding furnace, a pump that feeds the molten metal from the molten metal holding furnace into the plunger sleeve, and a control unit configured to set a molten metal feeding voltage based on the level of the molten metal detected by the molten metal level sensor, and the control unit configured to apply the molten metal feeding voltage to the pump to adjust an amount of the molten metal fed by the pump to a prescribed amount set in advance, the die casting method comprising:

detecting, by the molten metal level sensor, an initial level of the molten metal stored in the molten metal holding furnace before the pump starts feeding of the molten metal;

setting, by the control unit, an initial voltage as the molten metal feeding voltage based on the initial level of the molten metal such that the amount of the molten metal fed by the pump coincides with the prescribed amount;

applying, by the control unit, the initial voltage to the pump to cause the pump to start feeding of the molten metal from the molten metal holding furnace into the plunger sleeve;

repeatedly detecting, by the molten metal level sensor, a during-feeding level of the molten metal stored in the molten metal holding furnace during the feeding of the molten metal by the pump;

correcting, by the control unit, the molten metal feeding voltage to a during-feeding voltage based on the repeatedly detected during-feeding level of the molten metal such that the amount of the molten metal fed by the pump coincides with the prescribed amount;

applying, by the control unit, the during-feeding voltage to the pump to cause the pump to feed the molten metal from the molten metal holding furnace into the plunger sleeve; and performing casting through an injecting operation in which the molten metal fed into the plunger sleeve is extruded by the plunger tip to be injected into the cavity.

2. The die casting method according to claim 1, wherein, when the during-feeding level of the molten metal deviates from a reference value during the feeding of the molten metal, the control unit corrects the molten metal feeding voltage by adjusting the during-feeding voltage based on a deviation from the reference value.

3. The die casting method according to claim 2, wherein the control unit stores, as the reference value, a predicted change in the level of the molten metal in a case where an amount of the molten metal in the molten metal holding furnace decreases such that the amount of the molten metal fed by the pump coincides with the prescribed amount.

* * * * *